US009016170B2

(12) United States Patent
Nelson

(10) Patent No.: US 9,016,170 B2
(45) Date of Patent: Apr. 28, 2015

(54) COMBINATION FIVE GALLON BUCKET OPENER AND METHOD

(75) Inventor: Michael R. Nelson, Peachtree City, GA (US)

(73) Assignee: Homer TLC, Inc., Wilmington, DE (US)

( * ) Notice: Subject to any disclaimer, the term of this patent is extended or adjusted under 35 U.S.C. 154(b) by 226 days.

(21) Appl. No.: 13/492,308

(22) Filed: Jun. 8, 2012

(65) Prior Publication Data

US 2013/0327184 A1 Dec. 12, 2013

(51) Int. Cl.
*B67B 7/44* (2006.01)

(52) U.S. Cl.
CPC ..... *B67B 7/44* (2013.01)

(58) Field of Classification Search
CPC ..... B67B 7/12; B67B 7/14; B67B 7/18; B67B 7/42; B67B 7/44; B67B 7/16
USPC ..... 81/3.09, 3.4, 3.55, 3.07; 7/151
See application file for complete search history.

(56) References Cited

U.S. PATENT DOCUMENTS

| | | | | |
|---|---|---|---|---|
| 4,658,455 | A * | 4/1987 | Skillern | 7/105 |
| 5,069,090 | A * | 12/1991 | Clark | 81/3.09 |
| 6,578,223 | B1 * | 6/2003 | Link et al. | 81/3.09 |
| D657,643 | S * | 4/2012 | Mah et al. | D8/40 |
| 2003/0097909 | A1 * | 5/2003 | Pote | 81/3.4 |
| 2011/0185858 | A1 * | 8/2011 | Luo | 81/3.09 |

* cited by examiner

*Primary Examiner* — Hadi Shakeri
(74) *Attorney, Agent, or Firm* — Norton Rose Fulbright US LLP

(57) ABSTRACT

A combination five gallon bucket opener, includes a handle portion and a head portion, a first opener feature located in the head portion, the first opener feature having a plurality of engaging members and a bearing surface, at least one of the engaging members configured to receive a tab of a lid, at least one of the engaging members configured to engage a top surface of the lid, and a second opener feature located in the head portion, the second opener feature having at least one extended member configured to receive a cap, the at least one extended member having at least one feature defined therein to engage a corresponding feature on the cap.

6 Claims, 6 Drawing Sheets

COMBINATION FIVE GALLON BUCKET OPENER AND METHOD

BACKGROUND

A standard five gallon bucket, typically used to contain paint, building materials, foodstuffs, or other items, generally includes a lid that fastens to the bucket using a number of attachment points that are located around the periphery of the circumference of the lid. The lid typically includes a series of slots that define segmented tabs or other moveable features that are also spaced around the periphery of the circumference of the lid and which allow the edge of the lid to be pliable to facilitate removal of the lid from the bucket. This type of lid also typically includes a removable threaded cap, which can be removed to access the contents of the bucket without removing the entire lid. This arrangement of a cap threaded onto the lid allows two modes of access to the contents of the bucket.

To remove the entire lid, a tool is typically used to pry up the segmented portions of the lid around the periphery such that when enough of the segmented portions are lifted, the entire lid can be removed from the bucket. To remove the threaded cap, especially for the first time, a tool is typically used to engage the cap such that when sufficient rotational force is applied, the cap unscrews and can be removed from the lid.

Separate tools exist for the removal of the entire lid, and for the removal of the cap. However, it would be desirable to have a single tool to accomplish both lid removal and cap removal.

SUMMARY

Embodiments of the present invention relate to a combination five gallon bucket opener and method. In an embodiment, a combination five gallon bucket opener, includes a handle portion and a head portion, a first opener feature located in the head portion, the first opener feature having a plurality of engaging members and a bearing surface, at least one of the engaging members configured to receive a tab of a lid, at least one of the engaging members configured to engage a top surface of the lid, and a second opener feature located in the head portion, the second opener feature having at least one extended member configured to receive a cap, the at least one extended member having at least one feature defined therein to engage a corresponding feature on the cap.

Other systems, methods, features, and advantages of the invention will be or become apparent to one of skill in the art to which the invention relates upon examination of the following figures and detailed description. All such additional systems, methods, features, and advantages are encompassed by this description and the accompanying claims.

BRIEF DESCRIPTION OF THE FIGURES

The invention can be better understood with reference to the following figures. The elements shown in the figures are not necessarily to scale, emphasis instead being placed upon clearly illustrating the principles of the invention. Also, in the figures like reference numerals designate corresponding elements throughout the different views.

DETAILED DESCRIPTION

Figure 1:
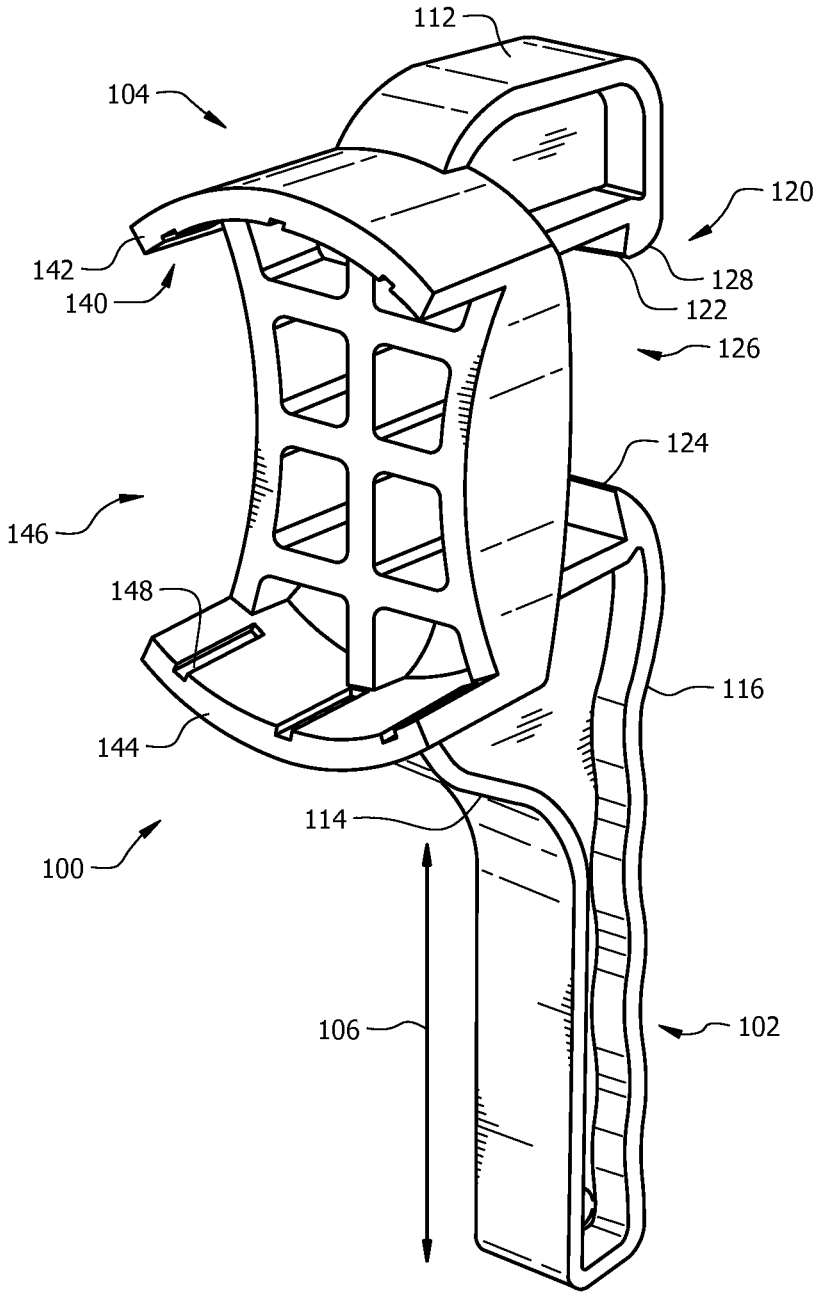
FIGS. 1 and 2 collectively illustrate perspective views an embodiment of a combination five gallon bucket opening tool.
Figure 2:
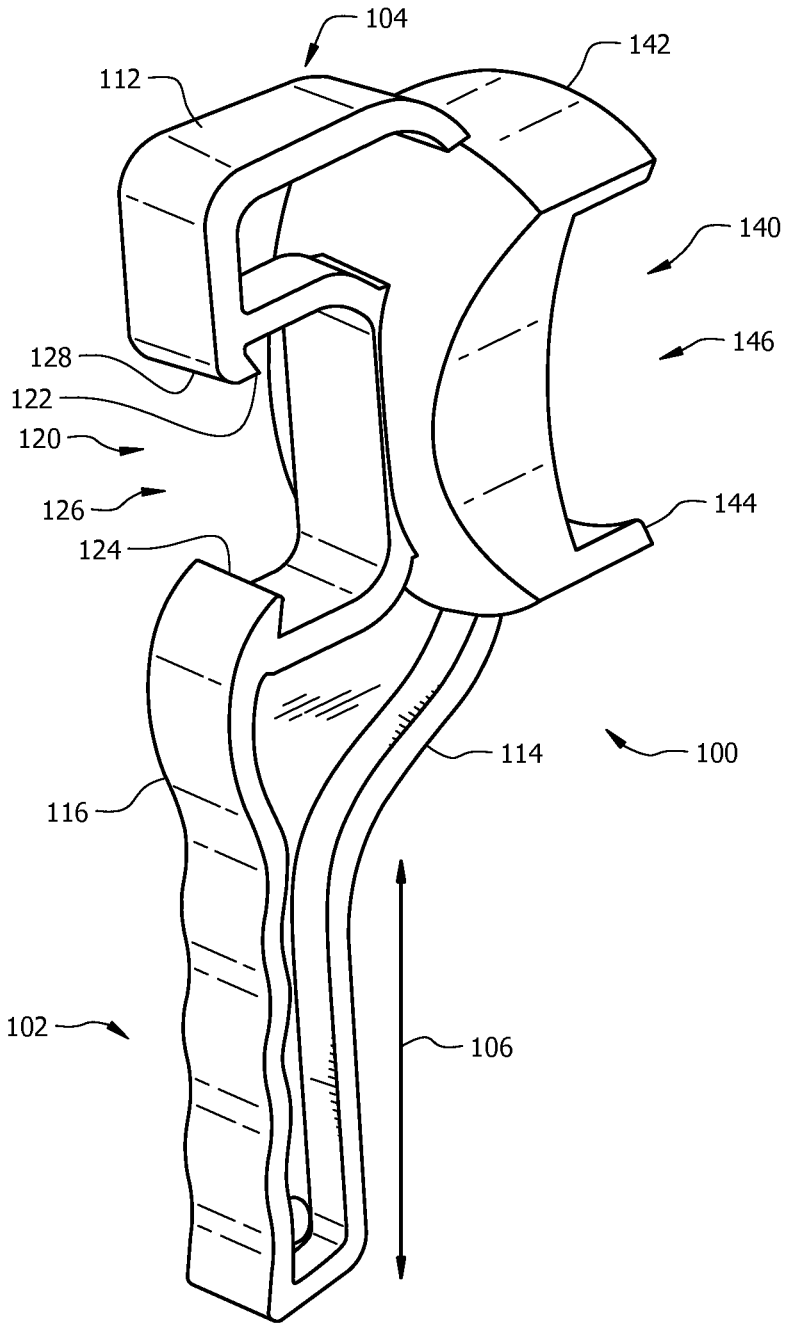

FIGS. 1 and 2 collectively illustrate perspective views an embodiment of a combination five gallon bucket opening tool 100. The tool 100 generally comprises a handle portion 102 and a head portion 104 generally aligned along a major axis 106. The head portion 104 includes a head 112 and a neck 114. The handle portion 102 generally includes a shoulder 116.

The head portion 104 generally comprises a first opener feature 120 and a second opener feature 140. The first opener feature 120 is also referred to as a lid opener feature, and the second opener feature 140 is also referred to as a cap opener feature.

The lid opener feature 120 generally includes a first lid engaging member 122 and a second lid engaging member 124. An opening 126 between the first lid engaging member 122 and the second lid engaging member 124 is configured to receive at least a portion of a lid of a five gallon paint bucket. The head portion 104 also comprises a bearing surface 128. In use, the bearing surface 128 engages against and exerts a force against the lid in a manner so as to aid in the removal of the lid from a five gallon bucket.

The second opener feature 140 generally includes a first cap engaging member 142 and a second cap engaging member 144. In the embodiment illustrated in FIGS. 1 and 2, the first cap engaging member 142 and the second cap engaging member 144 are shown as arcuate shapes that form a portion of a circular structure. In alternative embodiments, the first cap engaging member 142 and the second cap engaging member 144 can be other shapes, and indeed, can be a single generally circular element.

An opening 146 between the first cap engaging member 142 and the second cap engaging member 144 is configured to receive at least a portion of a screw on type cap that would fit on the lid of a five gallon paint bucket. The first cap engaging member 142 and the second cap engaging member 144 are formed to include a number of recesses 148. The recesses 148 are sized and located so as to receive corresponding ribs that are formed on the exterior surface of a cap that is designed to fit within the opening 146.

In the embodiment shown in FIGS. 1 and 2, the first opener feature 120 and the second opener feature 140 are integrally formed as part of the head portion 104 of the tool 100 so as to extend in opposite directions away from the axis 106.

Figure 3:
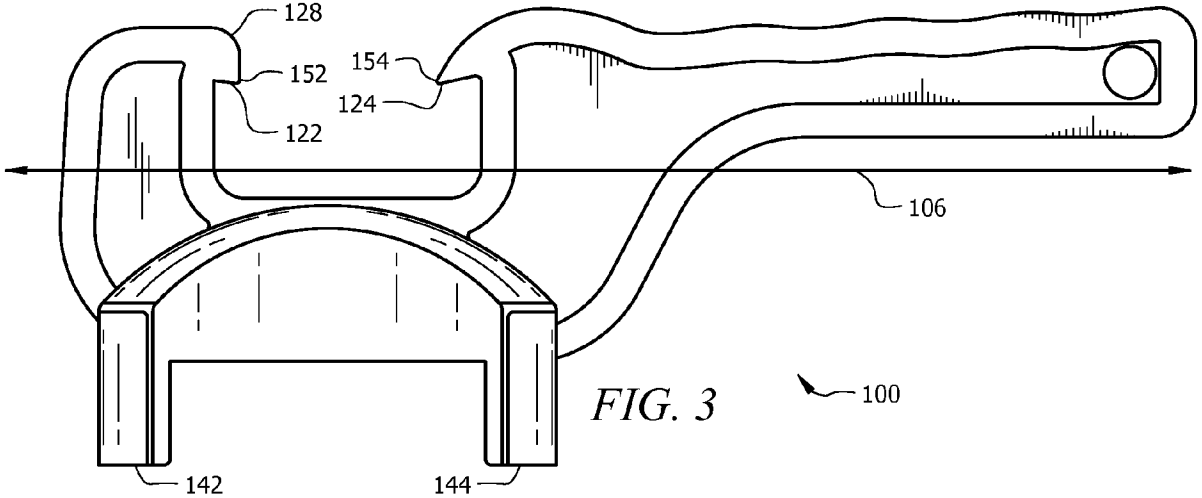
FIG. 3 is a plan view showing a first profile of the tool of FIGS. 1 and 2.

FIG. 3 is a plan view showing a first profile of the tool 100 of FIGS. 1 and 2. In an embodiment, the first lid engaging member 122 is formed to have a shape and profile that is different than the shape and profile of the second lid engaging member 124. Both the first lid engaging member 122 and the second lid engaging member 124 can be formed so that the leading edge 152 of the first lid engaging member 122 and the leading edge 154 of the second lid engaging member 124 extend inwardly toward the axis 106. In this manner, the first lid engaging member 122 and the second lid engaging member 124 are designed to grip a lid tab so that the second lid engaging member 124 has a sufficient grip so as to pry open the tab when the bearing surface 128 is located against a lid, as will be described below.

Figure 4:
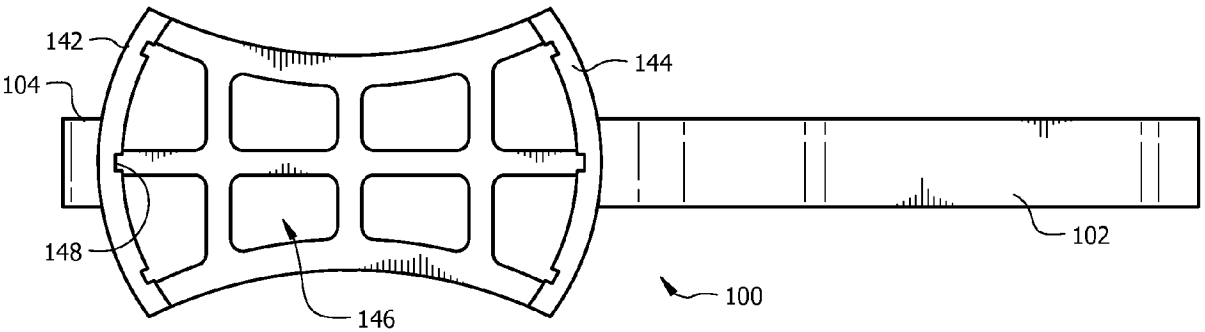
FIG. 4 is a plan view showing a second profile of the tool of FIGS. 1 and 2.

FIG. 4 is a plan view showing a second profile of the tool 100 of FIGS. 1 and 2. The first cap engaging member 142 and the second cap engaging member 144 include a plurality of recesses 148. The recesses 148 are sized and located so as to receive corresponding ribs that are formed on the exterior surface of a cap that is designed to fit within the opening 146.

Figure 5:
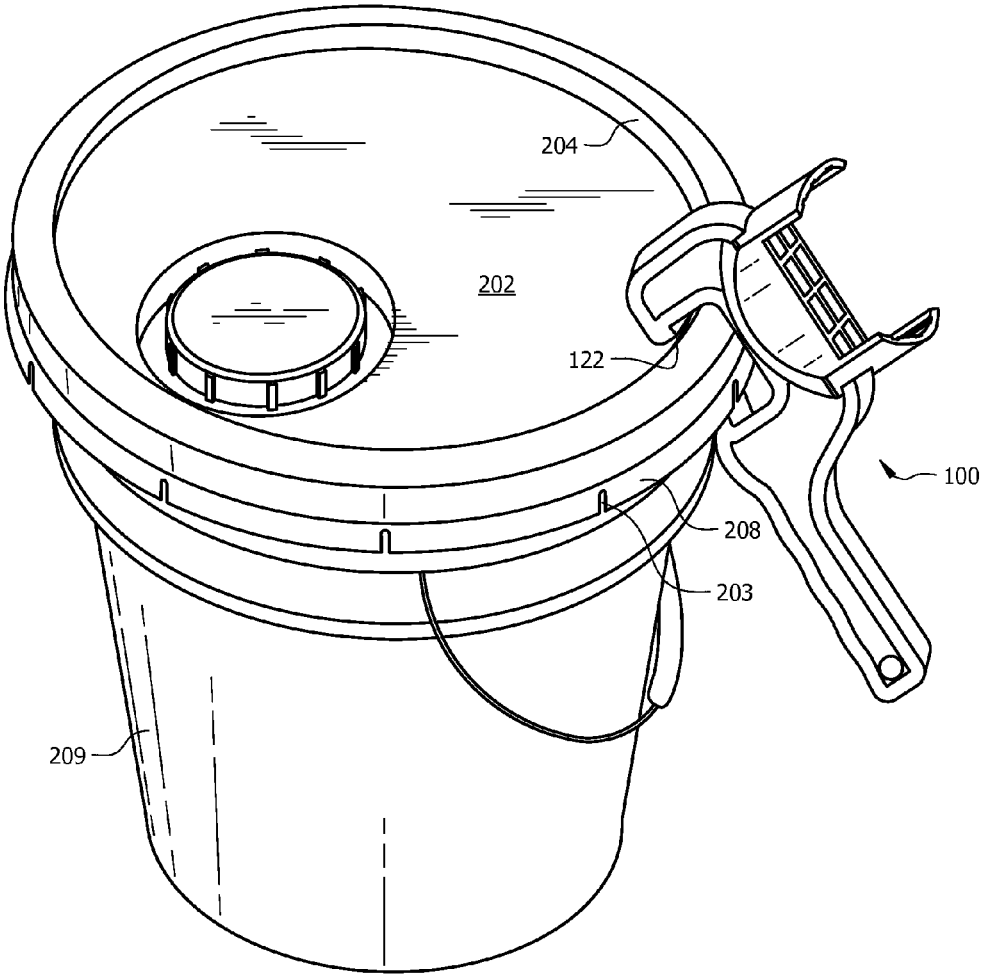
FIG. 5 is a perspective view illustrating the use of the first opener feature of the tool.
Figure 6:
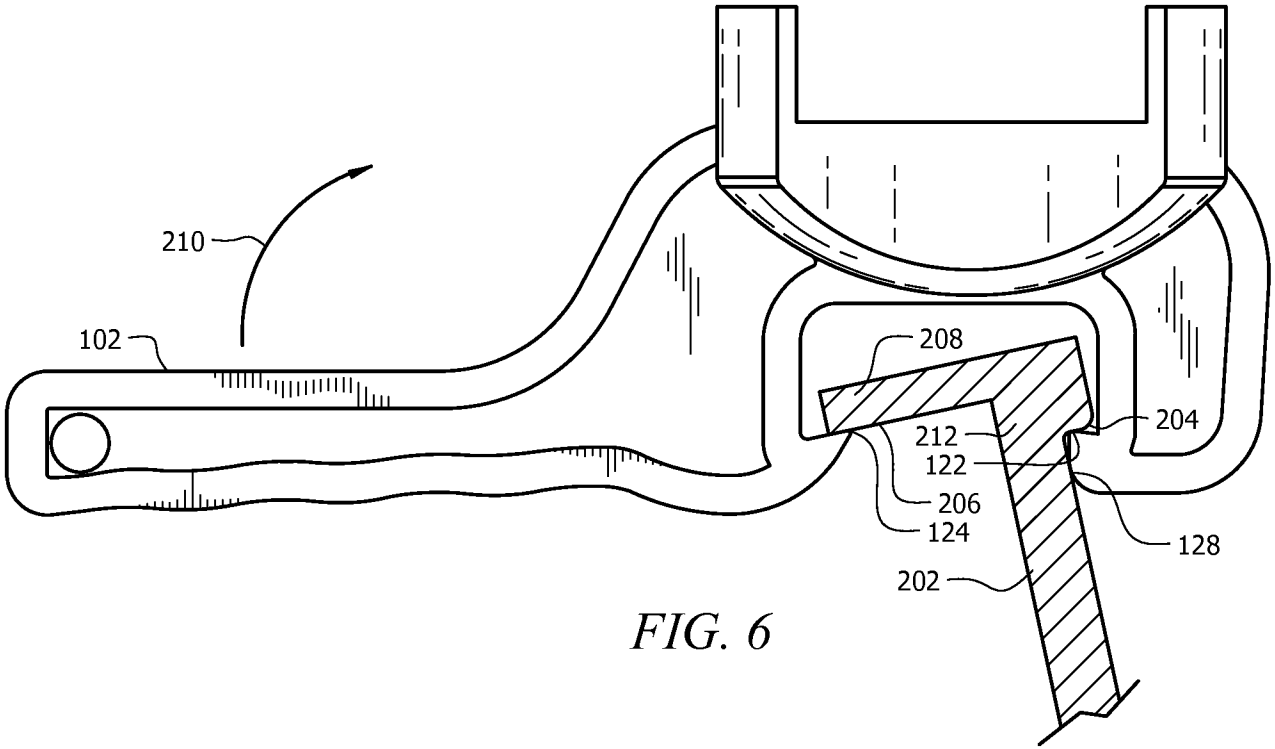
FIG. 6 is a cross-sectional view illustrating the use of the first opener feature of the tool.

FIG. 5 is a perspective view illustrating the use of the first opener feature of the tool 100. FIG. 6 is a cross-sectional view illustrating the use of the first opener feature of the tool 100. The periphery of a lid 202 generally comprises slots 203 that create tabs 208 that snap against and fasten the lid 202 to a five gallon paint bucket. The tool 100 engages the lid 202 such that the first lid engaging member 122 rests against a wall 204 of the lid 202 and the second lid engaging member 124 engages an underside portion 206 of a tab 208 formed in the lid 202. The bearing surface 128 contacts the lid as the tool 100 is used to pry in a general upward direction illustrated by the arrow 210. As the handle portion 102 of the tool 100 is moved in the direction of the arrow 210, the second lid engaging member 124 exerts force against the underside portion 206 of the tab 208 causing the tab 206 to move away from the portion 212 of the lid 202 such that the tab 208 separates from the 5 gallon paint bucket 209 (FIG. 5) thus facilitating removal of the lid 202.

Figure 7:
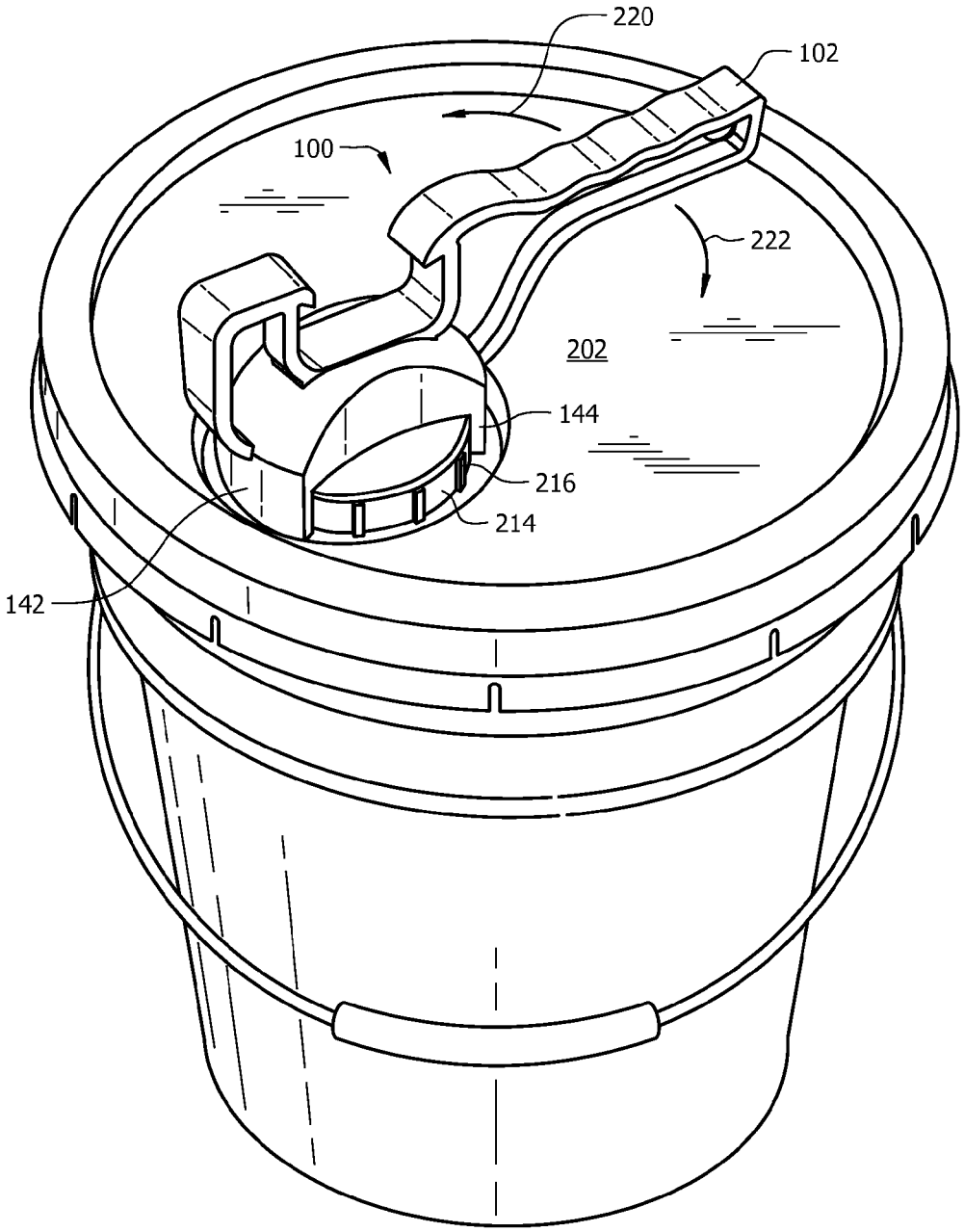
FIG. 7 is a perspective view illustrating the use of the second opener feature of the tool.

FIG. 7 is a perspective view illustrating the use of the second opener feature of the tool 100. The first cap engaging member 142 and the second cap engaging member 144 engage a cap 214. The cap 214 is typically threaded onto the lid 202. Recesses 148 (FIG. 4) in the first engaging member 142 and the second engaging member 144 engage ribs 216 on the outer surface of the cap 214. The tool 100 provides leverage so that when force is applied in the direction of the arrow 220, the cap 214 can be easily unfastened. Conversely, the tool 100 can exert leverage to tighten the cap 214 when force is applied to the handle 102 in the direction of the arrow 222.

The tool 100 can be formed using a variety of tool fabrication, forming, molding, or other processes, as known in the art. Specifically, the tool 100 can be formed so as to include the handle portion 102 and the head portion 104 as a unitary structure. The first opener feature 120 formed in the head portion 104 can be formed to include the first lid engaging member 122, the second lid engaging member 124 and the bearing surface 128. The second opener feature 140 formed in the head portion 104 can be formed to include the first cap engaging member 142 and the second cap engaging member 144. The recesses 148 can be formed in the first cap engaging member 142 and the second cap engaging member 144.

While one or more embodiments of the invention have been described as illustrative of or examples of the invention, it will be apparent to those of ordinary skill in the art that other embodiments are possible that are within the scope of the invention. Accordingly, the scope of the invention is not to be limited by such embodiments but rather is determined by the appended claims.

What is claimed is:

1. A combination five gallon bucket opener, comprising:

a handle portion including an undulating first surface forming finger grasping depressions and a shoulder and a head portion including a head and a neck opposite the shoulder;

a first opener feature located in the head portion, the first opener feature having a plurality of engaging members and a bearing surface, at least one of the engaging members configured to receive a tab of a lid, at least one of the engaging members configured to engage a top surface of the lid; and a second opener feature located in the head portion and integrally formed with the first opener feature, the second opener feature having a plurality of arcuate cap engaging members configured to receive a cap, each of the plurality of arcuate cap engaging members having at least three recess features defined therein to engage corresponding ribs on the cap, the arcuate cap engaging members, together, forming an incomplete circular structure; wherein the first opener feature and the second opener feature extend in opposite directions away from each other.

2. The combination five gallon bucket opener of claim 1, wherein the at least one member of the first opener feature configured to receive the tab of the lid extends inwardly.

3. The combination five gallon bucket opener of claim 1, wherein the first opener feature comprises a first lid engaging member configured to engage a tab of a lid and a second lid engaging member configured to engage a wall of the lid.

4. A method for making a combination five gallon bucket opener, comprising:

forming a handle portion including an undulating first surface forming finger grasping depressions and a shoulder and a head portion including a head and a neck opposite the shoulder; forming a first opener feature in the head portion, the first opener feature formed to have a plurality of engaging members and a bearing surface, at least one of the engaging members formed to receive a tab of a lid, at least one of the engaging members formed to engage a top surface of the lid; and forming integrally with the first opener feature a second opener feature located in the head portion, the second opener feature formed to have a plurality of arcuate cap engaging members configured to receive a cap, each of the plurality of arcuate cap engaging members having at least three recess features defined therein to engage corresponding ribs on the cap, the arcuate cap engaging members, together, forming an incomplete circular structure;

wherein the first opener feature and the second opener feature extend in opposite directions away from each other.

5. The method of claim 4, wherein the at least one member of the first opener feature formed to receive the tab of the lid is formed to extend inwardly.

6. The method of claim 4, wherein forming the first opener feature further comprising forming a first lid engaging member to engage a tab of a lid and forming a second lid engaging member to engage a wall of the lid.

* * * * *